US005082457A

United States Patent [19]

Wollscheidt et al.

[11] Patent Number: 5,082,457

[45] Date of Patent: Jan. 21, 1992

[54] FILTER ELECTRICAL CONNECTOR

[75] Inventors: Allen N. Wollscheidt, Columbus; David P. Porter, Greenwood, both of Ind.

[73] Assignee: Cummins Electronics Company, Inc., Columbus, Ind.

[21] Appl. No.: 677,654

[22] Filed: Mar. 29, 1991

[51] Int. Cl.[5] ..... H01R 13/66

[52] U.S. Cl. ..... 439/620; 333/183

[58] Field of Search ..... 439/620; 183/182, 183

[56] References Cited

U.S. PATENT DOCUMENTS

| | | | |
|---|---|---|---|
| 4,126,840 | 11/1978 | Selvin . | |
| 4,173,745 | 11/1979 | Saunders | 333/182 |
| 4,268,105 | 5/1981 | Widmayer et al. | 439/620 X |
| 4,431,251 | 2/1984 | Krantz | 439/620 X |
| 4,500,159 | 2/1985 | Briones et al. . | |
| 4,726,790 | 2/1988 | Hadjis . | |
| 4,729,743 | 3/1988 | Farrar et al. . | |
| 4,761,147 | 8/1988 | Gauthier . | |
| 4,772,221 | 9/1988 | Kozlof . | |
| 4,784,618 | 11/1988 | Sakamoto et al. . | |
| 4,791,391 | 12/1988 | Linnell et al. . | |
| 4,867,706 | 9/1989 | Tang . | |
| 4,929,196 | 5/1990 | Ponn et al. . | |
| 4,937,936 | 7/1990 | Schill et al. | 439/620 X |
| 4,954,794 | 9/1990 | Nieman et al. . | |
| 4,992,061 | 2/1991 | Brush, Jr. et al. . | |
| 5,032,091 | 7/1991 | Itzkoff | 439/620 |

*Primary Examiner*—Eugene F. Desmond

*Attorney, Agent, or Firm*—Woodard, Emhardt, Naughton, Moriarty & McNett

[57] ABSTRACT

A filter electrical connector includes a plug housing, a center housing and a receptacle housing connected in series by a number of connecting screws. The plug housing and center housing define a central filter cavity. The plug housing and receptacle housing provide means for receiving electrical connectors associated with an electronic device requiring EMI filtering. A T-type filter arrangement is provided within the filter cavity of the connector adapter. The filter arrangement includes PC board mounted capacitors, each in electrical connection between a corresponding connecting pin and a robust common ground. This ground is extended through the ground plane of the PC board, to the plug housing, through an electrical gasket to the conductive case of the electrical device requiring the EMI filtered signal. Each connecting pin extends through corresponding openings in a pair of ferrite wafers. Each one of the pair of ferrite wafers is situated on opposite sides of the PC board to sandwich the capacitors therebetween.

9 Claims, 1 Drawing Sheet

FILTER ELECTRICAL CONNECTOR

BACKGROUND OF THE INVENTION

The present invention relates to a filter connector device which is used to filter electromagnetic interference (EMI) or noise from signals passing between two electrical conductors.

Electrical filter connectors for filtering electronic equipment from electromagnetic interference (EMI) and radio frequency interference (RFI) are well known in the electrical connector art. For example, some electrical filter connectors utilize monolithic chip capacitors, thick film capacitors, or ferrite materials. Many electronic components integrate capacitors and inductors into the electrical signal receiving circuitry in order to perform the EMI filtering functions. With miniaturization of electrical components and the application of solid state electronic and microcomputer devices in harsher environments, the need for efficient electrical filter connectors has increased.

Attempts have been made in the prior art to configure a connector adapter for engagement between two electrical connectors, such as standard rectangular male and female pin connectors. There is a need for an inexpensive and easy to assemble connector adapter which incorporates optimum filtering capabilities. It has been found that the use of pi-type filters, although effective for many types of EMI filtering, is often inappropriate when dynamic signals are to be transmitted between connectors. It is therefore desirable to implement a different filter structure, such as a T-type filter, to minimize the effect on the driver or dynamic signal while optimizing the noise attenuation or filtering effect of the device.

DESCRIPTION OF THE PREFERRED EMBODIMENT

Figure 1:
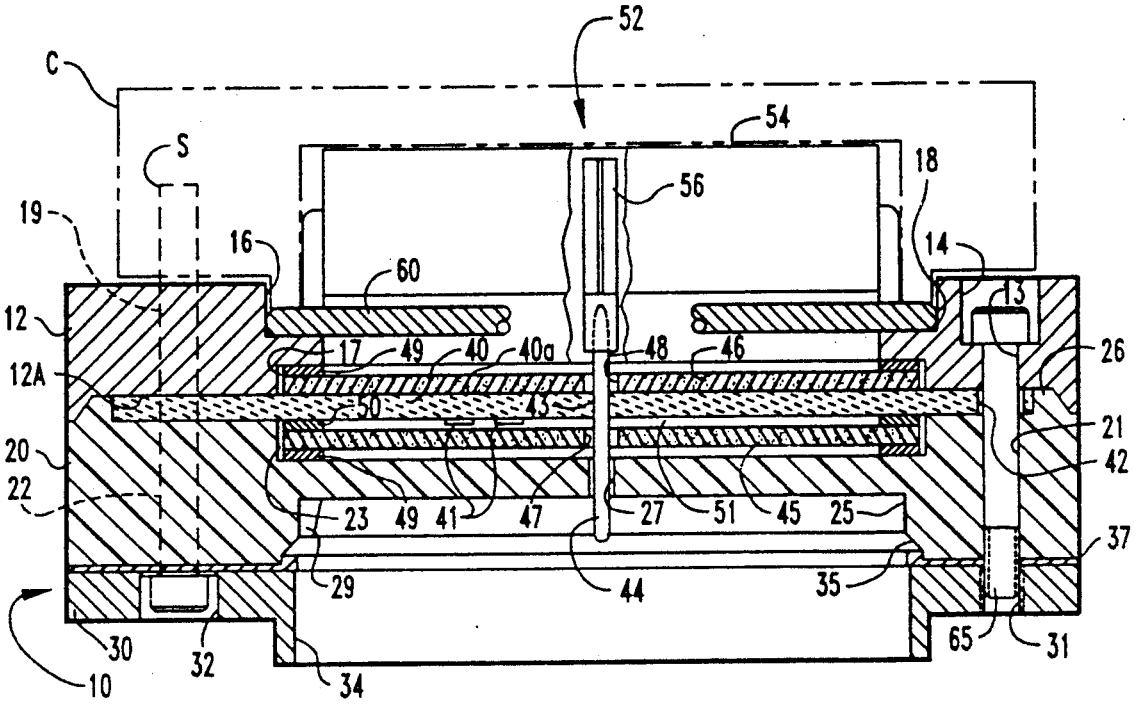
FIG. 1 is a side cross sectional view of the filter electrical connector of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as they would normally occur to one skilled in the art to which the invention relates.

In FIG. 1, a filter electrical connector or adapter 10 according to the present invention is shown. The filter connector 10 includes three housings—a plug housing 12, a center housing 20, and a receptacle housing 30. The plug housing 12 is formed of a good electrically conductive material, such as aluminum. The plug housing 12 includes a number of bores 13, each opening into a screw recess 14, to accept a number of connecting screws for assembling the entire filter connector 10. An outwardly opening connecting recess 16 and an interior filter cavity recess 17 are formed within the plug housing 12. At the base of the connecting recess is an electrical connection face 18. The plug housing 12 also includes a number of bores 19 therethrough to accept screws for engaging the filter connector 10 with the mating connector portion of a conducting case C integrated with the electronic device requiring the EMI filtered electrical signal, as shown in phantom lines in FIG. 1. The case C can be a faraday cage surrounding the engagement between the filter connector 10 and the electronic device.

Adjacent the plug housing 12 is a center housing 20 which itself includes a number of screw bores 21 to provide interconnection between the separate housings. The center housing 20 also includes a number of bores 22 aligned with the bores 19 in the plug housing 12. The center housing includes a filter cavity recess 23, which in the assembled configuration of the filter connector complements the filter cavity recess 17 of the plug housing 12 to form a filter cavity between the two housings. The center housing 20 further includes a receptacle recess 25 which is generally configured to correspond to the mating end of another mating electrical connector, such as a cabled connector. A key 29 is formed within the receptacle recess 25 to permit selective mating and to properly orient the mating end of the connector.

The edges of the center housing 20 are formed into a perimetrical locating ridge 26 which is used to locate the plug housing 12. The center housing 20 also includes a number of pin bores 27 which correspond in number to the number of pins in the mating electrical connectors to which the filter connector 10 is engaged. The center housing 20 must be formed from a non-conductive material, such as plastic or other suitable material.

The third housing is a receptacle housing 30 which can be molded from a conductive or non-conductive material. The receptacle housing 30 includes a number of threaded bores 31 for engaging a like number of connecting screws. Connecting screw 65 passes from the screw recess 14 and bore 13 in the plug housing 12, through the bore 21 in the center housing 20 to engage the threaded bore 31. The receptacle housing further includes a screw recess 32 for receiving the screw S engaging the filter connector 10 to the case C.

The receptacle housing 30 includes a receptacle enclosure 34 through which extends the mating electrical connector that resides within the receptacle recess 25. A shoulder 35 is formed in the receptacle recess 25 of the center housing 12 to provide a feature for properly aligning the mating electrical connector within the recess 25. A rubber gasket 37 is trapped between the center housing 25 and receptacle housing 30 and extends slightly into the recess 25, as shown in the figure, to seal against the mating connector when it is within the receptacle recess 25.

The filter connector 10 further includes a printed circuit (PC) board 40 which is sandwiched between the plug housing 12 and the center housing 20. The PC board 40 includes a number of mounting holes 42 through which the connecting screws 65 extend when the filter connector 10 is assembled. The board also includes a number of pin holes 43 through which connector pins 44 extend. The connector pins 44 are soldered or otherwise electrically connected to the PC board 40 in order to establish electrical connection with an electrical circuit pattern on the board.

The PC board 40 includes a number of capacitors 41 mounted thereon in electrical contact with the circuit pattern. The capacitors 41 and board 40 can be of conventional thick film construction or can include dielectric body type capacitors, such as chip or disc capacitors, electrically mounted thereon. PC boards with a number of capacitors arranged to correspond to connector pin locations are well-known in the art.

Each of the number of connecting pins 44 fixed to the PC board 40 is in electrical contact with a corresponding one of the capacitors 41 through the circuit pattern on the board 40. The circuit pattern on and within the PC board 40 affords intimate, low-inductance electrical connection between the pins 44 and the capacitors 41. The circuit pattern also provides a low-inductance connection from all of the capacitors 41 to a the PC ground plane 40*a*. In an important aspect of the filter connector 10, the PC board ground plane 40*a* is maintained in intimate electrical contact with the conductive surface 12*a* of the plug housing 12 to extend the capacitor ground.

The capacitor ground is further extended by assuring a solid electrical connection between the conductive plug housing 12 and the conductive case C of the mating connector portion of the device to which the filter connector 10 mounts. In particular, a garter spring 60 is disposed in the connecting recess 16 of the plug housing 12. The garter spring 60 is formed of an electrically conductive material to provide electrical connection between the electrical connection face 18 of the plug housing 12 and the case C. The spring 60 is preferably formed of an material that is electrochemically compatible with the surfaces of the plug housing 12 and the case C.

The garter spring 60 operates as an electrical gasket to provide a robust ground for the capacitors 41 on the PC board 40. It is important that sufficient fastening be provided among all the components of the filter connector 10 and between the filter connector and the conductive case C to ensure relatively uniform compression of the garter spring 60 between the plug housing 12 and case C. Uniform compression of the spring 60 produces an intimate low-inductance grounding path from the capacitors 41 and the case C of the electrical device.

Figure 2:
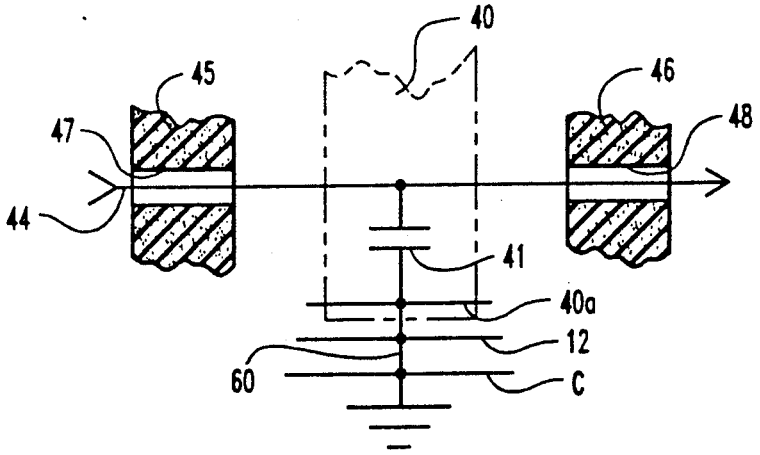
FIG. 2 is an electrical schematic representation of the filtering circuitry of the filter electrical connector of FIG. 1.

As schematically represented in FIG. 2, the capacitors 41 and extended ground described above form a T-type filter circuit. The extended ground is shown extending from the capacitors 41, through the PC board ground plane 40*a*, to the plug housing 12 and garter spring 60 to the mating connector case C. Functionally, this conductive path operates to extend a low inductance path between the faraday cage case C and the capacitors 41, thereby improving the filtering efficiency of the T-filter circuit.

Situated on either side of the PC board 40 is a pair of multi-hole ferrite wafers 45 and 46. In the preferred embodiment, each of the ferrite wafers 45 and 46 includes a number of pin bores 47 and 48. The pin bores 47 and 48 are aligned with the pin holes 43 in the PC board 40 and, more particularly, with the connector pins 44 themselves. The pin bores 47 and 48 are sufficiently large to provide clearance for the connector pins 44 to pass therethrough. (The bores have been dimensionally exaggerated in FIG. 1 for clarity). Compressible gaskets 49 on opposite sides of the wafers are used to locate the ferrite wafers 45 and 46 within the filter cavities 17 and 23. The gaskets, which are preferably formed of rubber, permit compression of the stack of the two wafers and the PC board 40 within the cavity formed by the two filter recesses 17 and 23. This cavity completely encloses and protects the filter circuit elements.

In one aspect of the invention, an additional gasket 50 is provided between the ferrite wafer 45 and the PC board 40. This gasket 50 offsets the wafer from the surface of the board 40 to form a cavity 51 within which the capacitors 41 reside. The ferrite wafer 46 on the ground plane side of the PC board 40 may be in contact with the board, or may also be offset by the addition of another gasket oriented between the board and the wafer 46.

It is understood that the ferrite wafers 45 and 46 provide the inductances in the T-type filter circuit arrangement depicted in FIG. 2. The wafers can be formed from a ferrite plate in a conventional manner of a material having a very low electrical conductivity or that is at least coated in the bores 47 and 48 by a suitable non-conductive material.

In the preferred embodiment of the filter connector 10, a female connector adaptor 52 is provided which includes a housing 54 and a number of female socket pins 56. Each of the female pins 56 mates with a corresponding one of the connector pins 44, as shown in FIG. 1. The socket pins 56 and connecting pins 44 are preferably electrically and mechanically fastened together by crimping, soldering or other appropriate means. It is understood that the socket pins 56 provide means for electrical connection with a mating electrical connector associated with the electronic device.

While the preferred embodiment is illustrated as including a pair of multi-hole ferrite wafers 45 and 46, two sets of ferrite beads may be substituted. In this configuration, a pair of beads corresponds to a single connecting pin with the connecting pin extending therethrough. Either the wafer or bead construction provides an inductive component on either side of the capacitors 41 on the PC board 40. With this T-type filter, the connector pins 44 can carry dynamic signals without being significantly affected by the filter circuit.

It is understood that the filter connector 10 as depicted in FIG. 1 includes a number of connecting pins 44. The number of connecting pins 44 depends, of course, upon the number of electrical connections provided by the connectors associated with the electronic components. Further, only one attachment screw 65 is shown in the figure, although additional screws may be used to firmly connect each of the housings of the filter electrical connector 10 of the present invention. Likewise, more than one screw S may be provided to engage the filter connector 10 to the case C.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A filter electrical connector for engagement between a first and a second mating electrical connector, in which the first mating connector is electrically connected to an electronic device using EMI filtered signals carried by the filer electrical connector and includes a conductive case for a low inductance connection to the device ground, the filter electrical connector comprising:

a first housing formed of an electrically conductive material defining a first recess and having first means for engaging the first mating connector, a first conductive surface adjacent said first means for engaging and a second conductive surface displaced from said first surface;

a second housing formed of a non-conductive material and having means for engaging the second mating connector;

a filter assembly including:

a circuit board carrying a circuit pattern and a number of capacitor elements, said circuit board having a ground plane, said circuit pattern providing electrical connection between each of said number of capacitor elements and said ground plane; and a number of electrical connector pins attached to said circuit board, each of said pins being in electrical contact with a corresponding one of said number of capacitor elements, wherein said number of connector pins provide an electrical connection between the first and second mating connectors;

means for supporting said filter assembly between said first and second housings when said housing are connected together, whereby said ground plane of said circuit board is maintained in intimate electrical contact with said second conductive surface of said first housing;

means for connecting said first housing and said second housing together; and means for providing a low inductance electrical contact between said first conductive surface of said first housing and the case of the first mating connector when the first mating connector is engaged to said first housing by said first means for engaging.

2. The filter electrical connector of claim 1, wherein:

said first means for engaging the first mating connector includes a plug recess defined in said first housing and adapted to recess the case of the first mating connector therein;

said first conductive surface being situated within said recess; and said means for providing a low inductance electrical contact includes;

a compressible conductive element adjacent said first conductive surface of said first housing; and means for engaging said filter electrical connector to the case such that said conductive element is compressed between the case and said first conductive surface to form an intimate electrical contact therebetween.

3. The filter electrical connector of claim 2, wherein said compressible conductive element is a garter spring electrical gasket.

4. The filter electrical connector of claim 1, wherein said filter assembly further includes:

a pair of inductor elements adjacent opposite surfaces of said circuit board, each of said pair of inductor elements including a number of holes therethrough to receive said number of connector pins therethrough.

5. A filter electrical connector for engagement between a first and a second mating electrical connector comprising:

a first housing defining a first recess at a first mating face of said first housing and including first means for engaging the first mating electrical connector;

a second housing defining a second recess at a second mating face, said second recess being complementary to said first recess to form a cavity when said first and second mating faces are engaged, said second housing including second means for engaging the second mating electrical connector;

a filter assembly including;

a circuit board carrying a circuit pattern and a number of capacitor elements each connected through said circuit pattern to a common ground;

a pair of inductor elements adjacent opposite surfaces of said circuit board, each of said pair of inductor elements including a number of holes therethrough; and a number of first electrical connector pins attached to said circuit board, each of said pins being in electrical contact with a corresponding one of said number of capacitor elements and each projecting outwardly from said circuit board to extend through a corresponding one of said number of holes in each of said pair of inductor elements, wherein said number of connector pins provide an electrical connection between the first and second mating connectors;

means for supporting said filter assembly within said cavity when said first and second housings are connected together; and means for connecting said first and second housings together.

6. The filter electrical connector of claim 5, wherein each of said pair of inductor elements includes a ferrite wafer having said number of holes formed therethrough.

7. The filter electrical connector of claim 5, wherein said first means for engaging a first mating electrical connector includes:

a mating enclosure defined in said first housing;

a connector adaptor engaged within said mating enclosure, said connector adaptor including a number of second connector pins extending through said mating enclosure into electrical engagement with said first connector pins.

8. The filter electrical connector of claim 5, wherein:

each of said number of capacitor elements is a chip capacitor mounted to one of said opposite surfaces of said circuit board; and said filter assembly further includes a gasket between one of said pair of inductor elements and said one of said opposite surfaces of said circuit board to offset said one of said pair of inductor elements from said one of said opposite surfaces to form a capacitor cavity therebetween to receive said number of capacitors therein.

9. The filter electrical connector of claim 5, wherein:

said means for supporting said filter assembly within said cavity includes a pair of resilient gaskets, one each disposed between one each of said pair of inductor elements and a corresponding one of said first recess and said second recess, whereby when said first and second housings are connected a stack including one of said pair of gaskets, one of said pair of inductor elements, said circuit board, the other of said pair of inductor elements and the other of said pair of gaskets is compressed within said cavity.

* * * * *